US009664077B2

(12) United States Patent
Zahdeh

(10) Patent No.: US 9,664,077 B2
(45) Date of Patent: May 30, 2017

(54) OIL PAN AND ENGINE ASSEMBLY INCLUDING THE OIL PAN

(71) Applicant: GM GLOBAL TECHNOLOGY OPERATIONS LLC, Detroit, MI (US)

(72) Inventor: Akram R. Zahdeh, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 75 days.

(21) Appl. No.: 14/814,548

(22) Filed: Jul. 31, 2015

(65) Prior Publication Data

US 2016/0222845 A1 Aug. 4, 2016

Related U.S. Application Data

(60) Provisional application No. 62/110,763, filed on Feb. 2, 2015.

(51) Int. Cl.

| | |
|---|---|
| ***F01M 11/00*** | (2006.01) |
| ***F01M 5/00*** | (2006.01) |
| *F01M 5/02* | (2006.01) |

(52) U.S. Cl.

CPC ..... *F01M 11/0004* (2013.01); *F01M 5/001* (2013.01); *F01M 2005/023* (2013.01); *F01M 2011/0025* (2013.01); *F01M 2011/0037* (2013.01); *F01M 2011/0045* (2013.01)

(58) Field of Classification Search

CPC ..... F01M 2011/0045; F01M 11/0004

See application file for complete search history.

(56) References Cited

U.S. PATENT DOCUMENTS

| | | | | |
|---|---|---|---|---|
| 4,134,380 | A * | 1/1979 | Niwa | F01M 5/005 123/142.5 E |
| 4,296,716 | A * | 10/1981 | Hofbauer | F01M 5/00 123/195 C |
| 5,301,642 | A * | 4/1994 | Matsushiro | F01M 5/001 123/142.5 R |
| 5,934,241 | A * | 8/1999 | Von Esebeck | B01D 35/30 123/196 R |
| 6,058,898 | A * | 5/2000 | Freese | F01M 11/0004 123/195 C |
| 6,299,561 | B1 * | 10/2001 | Kramer | F16H 57/0447 184/13.1 |

(Continued)

*Primary Examiner* — William E Dondero
*Assistant Examiner* — Mark K Buse
(74) *Attorney, Agent, or Firm* — Quinn IP Law

(57) ABSTRACT

An engine assembly includes an oil pan having an oil pan body. The oil pan body includes an inner pan surface defining a cavity configured to collect oil and an outer pan surface opposite the inner pan surface. Further, the oil pan includes a dividing wall disposed within the cavity and coupled to the oil pan body. The dividing wall divides the cavity into a first compartment and a second compartment. The oil pan defines an opening extending through the dividing wall. A valve is disposed in the opening and can move between an open position and a closed position. When the valve is in the open position, the first compartment is in fluid communication with the second compartment. When the valve is in the closed position, the valve blocks fluid flow between the first compartment and the second compartment via the opening.

12 Claims, 2 Drawing Sheets

(56) References Cited

U.S. PATENT DOCUMENTS

| | | | | |
|---|---|---|---|---|
| 6,705,270 | B1 * | 3/2004 | Rau | F01M 11/0004 123/195 C |
| 7,946,388 | B2 * | 5/2011 | Kobayashi | F01M 5/02 184/1.5 |
| 8,100,106 | B2 * | 1/2012 | Kardos | F01M 5/00 123/142.5 R |
| 8,333,264 | B2 * | 12/2012 | Curtis | F16H 57/031 184/6.12 |
| 8,635,983 | B2 * | 1/2014 | Enokida | F01M 11/0004 123/195 C |
| 9,399,935 | B2 * | 7/2016 | Inoue | F01M 11/0004 |
| 2010/0000475 | A1 * | 1/2010 | Kardos | F01M 5/00 123/41.31 |
| 2015/0300220 | A1 * | 10/2015 | Mordukhovich | F01M 11/0004 184/106 |

* cited by examiner

OIL PAN AND ENGINE ASSEMBLY INCLUDING THE OIL PAN

CROSS-REFERENCE TO RELATED APPLICATIONS

This application claims the benefit of U.S. Provisional Application No. 62/110,763, filed Feb. 2, 2015, which is hereby incorporated by reference in its entirety.

TECHNICAL FIELD

The present disclosure relates to an oil pan and an engine assembly including the oil pan.

BACKGROUND

An oil pan can collect oil used to lubricate an internal combustion engine. During operation of the internal combustion engine, oil may circulate within the internal combustion engine to lubricate moving components of the internal combustion engine, dissipate thermal energy, and protect against wear of the internal combustion engine. After lubricating the moving parts of the engine, the oil is collected by the oil pan.

SUMMARY

To maximize fuel efficiency when an internal combustion engine is warming up, the oil in the oil pan should be heated to an optimum temperature as quickly as possible. When the oil is at its optimum temperature, fuel dilution in the oil can be minimized. In addition, the moisture in the oil can be minimized by maintaining the oil temperature at its optimum level, thereby maximizing the engine oil life. Accordingly, the presently disclosed engine assembly includes an oil pan capable of minimizing the time it takes to heat the oil when the internal combustion engine is warming up. In an embodiment, the engine assembly includes an oil pan having an oil pan body. The oil pan body includes an inner pan surface defining a cavity configured to collect oil and an outer pan surface opposite the inner pan surface. Further, the oil pan includes a dividing wall disposed within the cavity and coupled to the oil pan body. The dividing wall divides the cavity into a first compartment and a second compartment. The oil pan defines an opening extending through the dividing wall. A valve is disposed in the opening and can move relative to the dividing wall between an open position and a closed position. When the valve is in the open position, the first compartment is in fluid communication with the second compartment via the opening. When the valve is in the closed position, the valve blocks fluid flow between the first compartment and the second compartment via the opening. A heat exchanger may be disposed in the first compartment to facilitate heat transfer between the oil in the first compartment and the heat transfer fluid (e.g., coolant) flowing through the heat exchanger. The present disclosure also relates to a vehicle including the engine assembly described above.

The above features and advantages and other features and advantages of the present teachings are readily apparent from the following detailed description of the best modes for carrying out the teachings when taken in connection with the accompanying drawings.

DETAILED DESCRIPTION

Figure 1:
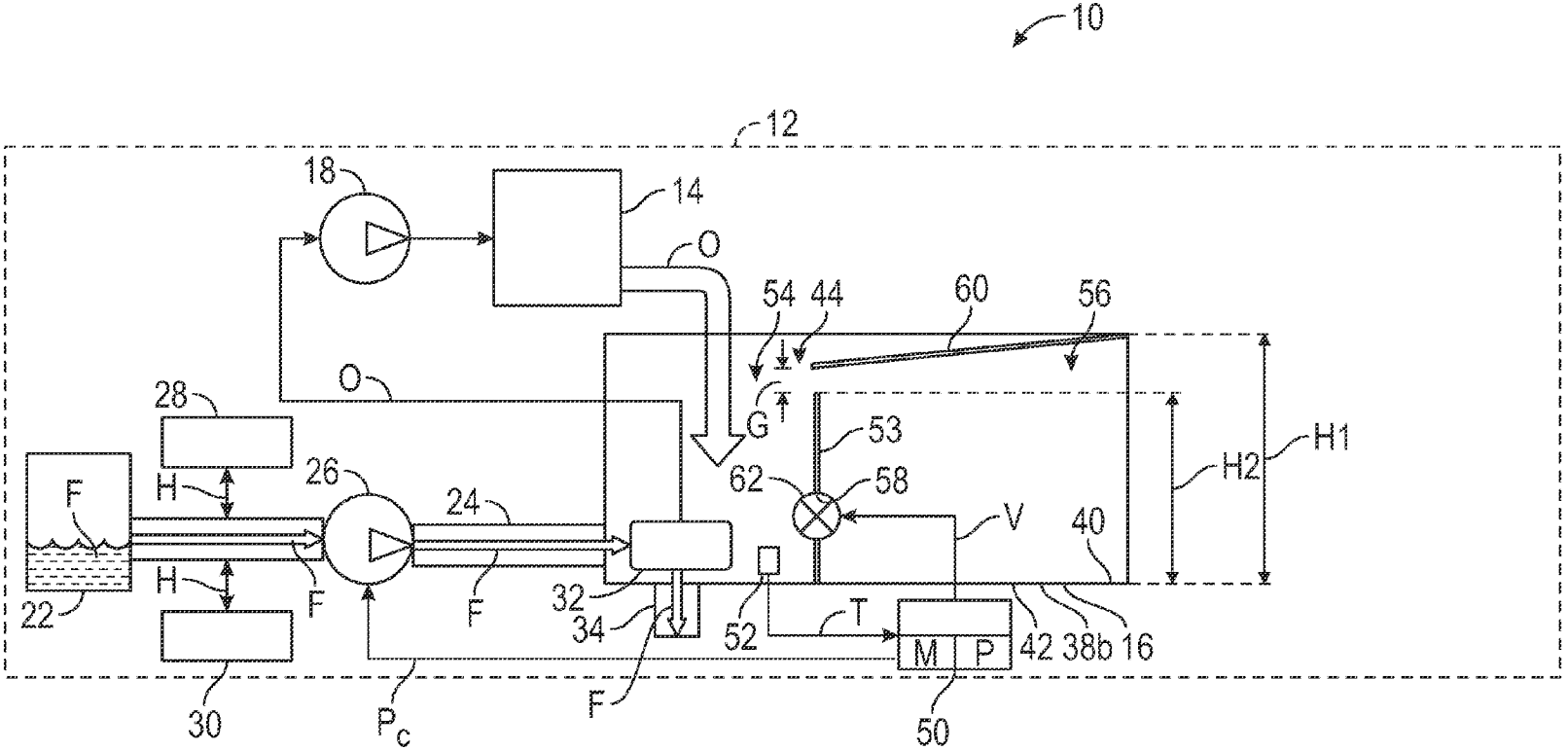
FIG. 1 is a schematic illustration of a vehicle including an engine assembly in accordance with an embodiment of the present disclosure, wherein the engine assembly includes an oil pan.
Figure 2:
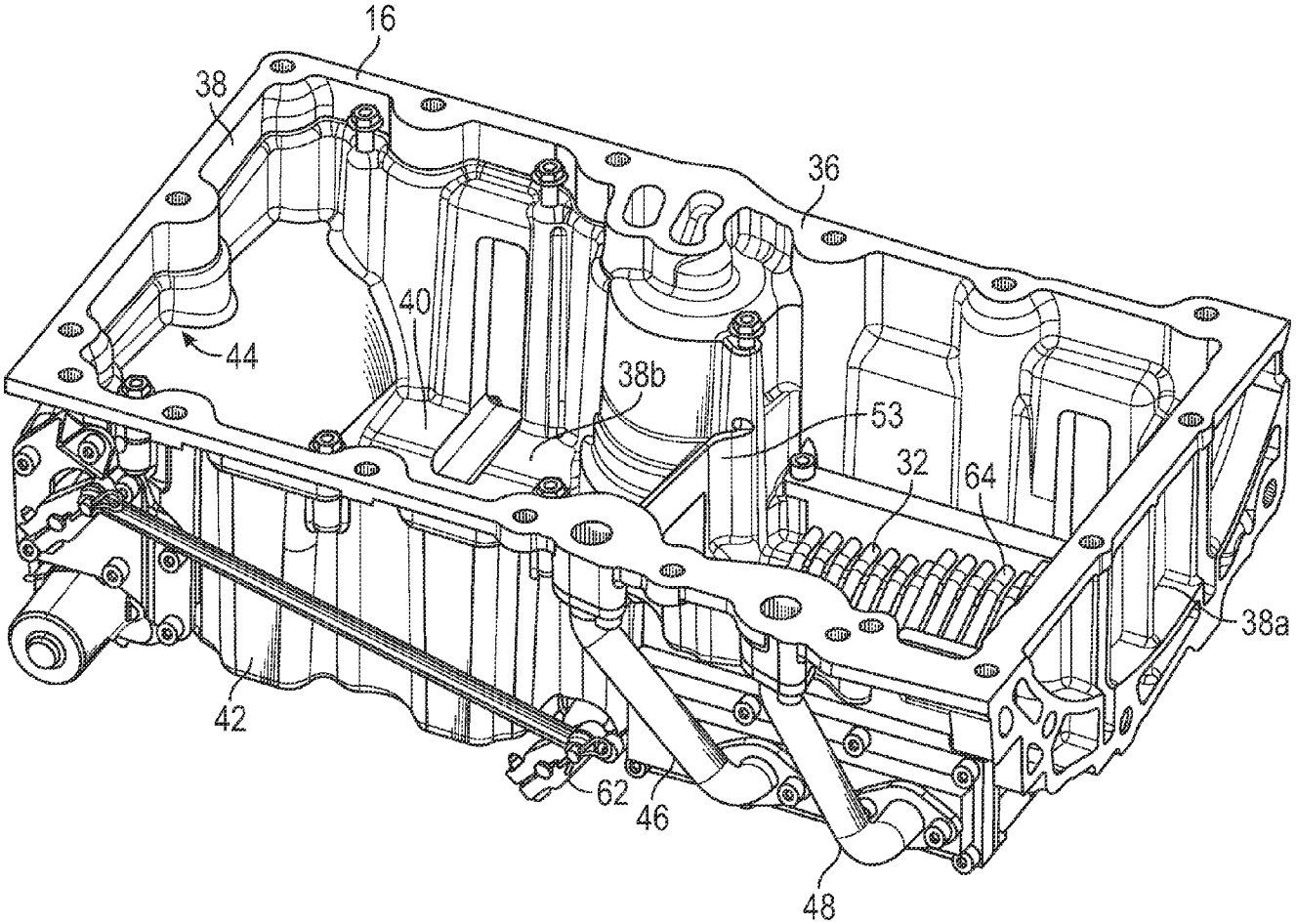
FIG. 2 is a schematic, perspective view of the oil pan shown in FIG. 1.

Referring to the drawings, wherein like reference numbers correspond to like or similar components throughout the several figures, referring to FIGS. 1 and 2, a vehicle 10, such as a car, includes an engine assembly 12. The engine assembly 12 includes an internal combustion engine 14 configured to propel the vehicle 10. The internal combustion engine 14 employs oil O for lubrication, among other things. The engine assembly 12 further includes an oil pan 16 coupled to the internal combustion engine 14. As a consequence, oil O can flow between the internal combustion engine 14 and the oil pan 16. Specifically, the oil O used to lubricate the internal combustion engine 14 can flow to the oil pan 16. The oil pan 16 then collects the oil O. The engine assembly 12 further includes an oil pump 18 coupled to the oil pan 16. Consequently, the oil pump 18 can move the oil O from the oil pan 16 back to the internal combustion engine 14 as well as to other vehicle components.

To maximize fuel efficiency when the internal combustion engine 14 is warming up, the oil O in the oil pan 16 should be heated to an optimum temperature as quickly as possible. When the oil O is at its optimum temperature, fuel dilution in the oil can be minimized. Additionally, the moisture in the oil O can be minimized by maintaining the oil temperature at its optimum level, thereby maximizing the engine oil life. The oil pan 16 of the engine assembly 12 can minimize the time it takes to heat the oil O when the internal combustion engine 14 is warming up as discussed below.

The oil pan 16 is wholly or partly made of a substantially rigid material, such as a rigid metallic material, and is configured to hold the oil O. In the depicted embodiment, the oil pan 16 includes an oil pan body 36 having a plurality of walls 38. For example, in the depicted embodiment, the oil pan 16 includes at least one sidewall **38*a* defining the perimeter of the oil pan 16 and at least one bottom wall 38*b* coupled to the sidewall 38*a*. The oil pan body 36 defines an inner pan surface 40 and an outer pan surface 42 opposite the inner pan surface 40. The inner pan surface 40 defines an open cavity 44** configured, shaped, and size to collect and hold the oil O.

The oil pan 16 includes a dividing wall 53 coupled to at least one of the walls 38. For example, the dividing wall 53 can be coupled to the sidewall **38*a* and/or the bottom wall 38*b*. Regardless, the dividing wall 53 divides the cavity 44 into a first compartment 54 and a second compartment 56. The second compartment 56 is larger than the first compartment 54. In other words, the first compartment 54 has a volume (i.e., the first volume) that is less than the volume (i.e., the second volume) of the second compartment 56 in order to minimize the time it takes to warm up the oil O in the oil pan 16, because the oil O is first heated or cooled in the first compartment 54 as discussed in detail below. As a non-limiting example, the volume of the first compartment 54 may range between ¼ to ⅕ of the total volume of the cavity 44, whereas the volume of the second compartment 56 may range between ¾ and ⅘ of the total volume of the cavity 44. These volume ranges ensure that the oil O in the first compartment 54 is heated (or cooled) as quickly as possible, because the first compartment 54, which is the smaller compartment, is used to warm up the oil O. Warming up the oil O first in the first compartment 54 helps reduce friction in the internal combustion engine 14. Accordingly, the oil O should initially be directed to the first compartment 54**.

The oil pan 16 further includes a drip pan 60 to direct the oil O stemming from other vehicle components, such as the internal combustion engine 14, into the first compartment 54. The drip pan 60 is coupled to the sidewall 38*a* and is at least partly disposed within the cavity 44. Moreover, the drip pan 60 is obliquely angled relative to the sidewall 38*a* and may extend along the entire length of the second compartment 56 in order to direct the oil O toward the first compartment 54. At least a portion of the drip pan 60 is disposed over the dividing wall 53. However, the drip pan 60 is spaced apart from the dividing wall 53 so as to define a gap G therebetween. Instead of (or in addition to) the drip pan 60, the oil pan 16 may include diverters to direct the oil O toward the first compartment 54. The gap G allows oil O to flow over the dividing wall 53 when amount of oil O in either the first compartment 54 or the second compartment 56 reaches a certain level. The height of the sidewall 38*a* (i.e., the first height H1) is greater than the height of the dividing wall 53 (i.e., the second height H2) in order to allow the oil pan 16 to hold the oil O even while the oil O is flowing over the dividing wall 53 through the gap G.

The oil pan 16 has an opening 58, such as a thru-hole, extending through the dividing wall 53, and the engine assembly 12 includes a valve 62 coupled to the dividing wall 53 in order to open or close the opening 58. Thus, the valve 62 is at least partly disposed within the opening 58 and may be a flapper valve or any kind of valve suitable to block fluid flow (e.g., oil flow) between the first compartment 54 and the second compartment 56 via the opening 58. Accordingly, the valve 62 can move between an open position and a closed position. When the valve 62 is in the open position, the first compartment 54 is in fluid communication with the second compartment 56 through opening 58 and, therefore, the oil O can flow between the first compartment 54 and the second compartment 56 via the opening 58. In the closed position, the valve 62 blocks fluid flow between the first compartment 54 and the second compartment 56.

The engine assembly 12 includes a heat exchanger 32 disposed within the first compartment 54. When the first compartment 54 is filled with oil O, the heat exchanger 32 may be submerged in the oil O. The heat exchanger 32 may include a plurality of conduits 64 (e.g., tubes) extending through the first compartment 54. Each conduit 64 is configured to carry a heat transfer fluid F. Accordingly, the heat transfer fluid F can flow through the heat exchanger 32 in order to facilitate heat transfer between the oil O in the first compartment 54 and the heat transfer fluid F flowing through the heat exchanger 32.

The engine assembly 12 further includes a heat transfer fluid source 22 capable of holding the heat transfer fluid F. The heat transfer fluid F can be any fluid (e.g., liquid) suitable for transferring heat. As a non-limiting example, the heat transfer fluid F may be a coolant, such as ethylene glycol. The fluid source 22 is in fluid communication with an input passageway 24 (e.g., conduit, tube, pipe, etc.). The input passageway 24 is outside the oil pan 16 and is fluidly coupled between the oil pan 16 and the fluid source 22. Accordingly, the heat transfer fluid F can flow from the fluid source 22 to the oil pan 16. A fluid transfer pump 26 is also coupled to the input passageway 24 in order to move the heat transfer fluid F from the fluid source 22 to the oil pan 16 through the input passageway 24.

The input passageway 24 is in thermal communication with a heat source 28. As a consequence, the heat source 28 can heat the heat transfer fluid F flowing through the input passageway 24. As non-limiting examples, the heat source 28 can be an exhaust manifold, an exhaust gas recirculation system, a turbocharger, an engine block, an engine head, or a combination thereof. Regardless of the kind of heat source 28 used, heat H can be transferred between the heat transfer fluid F flowing through the input passageway 24 and the heat source 28.

The input passageway 24 is in thermal communication with a cooling source 30. As a consequence, the cooling source 30 can cool the heat transfer fluid F flowing through the input passageway 24. As a non-limiting example, the cooling source 30 can be the cooling system of the vehicle 10. Irrespective of the kind of cooling source 30 used, heat H can be transferred between the heat transfer fluid F flowing through the input passageway 24 and the cooling source 30.

The heat exchanger 32 has an inlet 46 in fluid communication with the fluid source 22 through the input passageway 24. Therefore, the heat transfer fluid F can flow between the fluid source 22 and the heat exchanger 32. Further, the heat exchanger 32 includes an outlet 48 in fluid communication with the output passageway 34. Thus, the heat transfer fluid F can flow from the heat exchanger 32 to the output passageway 34 after the heat has been transferred between the oil O in the first compartment 54 of the oil pan 16 and the heat transfer fluid F flowing through the heat exchanger 32. Because the oil O in the oil pan 16 can be cooled by exchanging heat from the heat transfer fluid F, the engine assembly 12 does not need an oil cooler. Thus, the engine assembly 12 (and therefore the vehicle 10) does not have an oil cooler for cooling the oil O in the oil pan 16. However, the second compartment 56 may also include a heat exchange for cooling or heating the oil O.

The heat exchanger 32 is in fluid communication with the input passageway 24. Accordingly, the heat transfer fluid F can flow between the input passageway 24 and the heat exchanger 32. While flowing through the heat exchanger 32, heat can be transferred between the oil O in the first compartment 54 and the heat transfer fluid F flowing through the heat exchanger 32. The engine assembly 12 also includes an output passageway 34 (e.g., conduit, tube, pipe, etc.) outside the oil pan 16. The output passageway 34 is in fluid communication with the heat exchanger 32. Accordingly, the heat transfer fluid F can flow between the heat exchanger 32 and the output passageway 34 once heat has been transferred between the heat transfer fluid F flowing through the heat exchanger 32 and the oil O disposed in the oil pan 16. It is contemplated that the oil pan 16 may include one or more heat exchangers 32. Regardless of the quantity, the flowrate of the heat transfer fluid F flowing through the heat exchanger 32 can be adjusted by varying the power output of the fluid transfer pump 26 (i.e., the pump power).

The engine assembly 12 further includes a controller 50 in communication (e.g., electronic communication) with the fluid transfer pump 26. Accordingly, the controller 50 can command the fluid transfer pump 26 to adjust its power output (i.e., pump power). The controller 50 may include hardware elements such as a processor (P), memory (M), circuitry including but not limited to a timer, oscillator, analog-to-digital (A/D) circuitry, digital-to-analog (D/A) circuitry, a digital signal processor, and any necessary input/output (I/O) devices and other signal conditioning and/or buffer circuitry. The memory (M) may include tangible, non-transitory memory such as read only memory (ROM), e.g., magnetic, solid-state/flash, and/or optical memory, as well as sufficient amounts of random access memory (RAM), electrically-erasable programmable read-only memory (EEPROM), and the like. The controller 50 can send a signal (i.e., the power command signal Pc) to the fluid transfer pump 26 in order to increase or decrease its pump power. In other words, the controller 50 is programmed to adjust the pump power of the fluid transfer pump 26 in order to adjust the flowrate of the heat transfer fluid F flowing through the heat exchanger 32.

The engine assembly 12 further includes a temperature sensor 52 in communication (e.g., electronic communication) with the controller 50. The temperature sensor 52 may be a thermocouple or any other sensor suitable for measuring the temperature of the oil O. In the depicted embodiment, the temperature sensor 52 is disposed inside the first compartment 54 and can therefore measure the temperature of the oil O in the first compartment 54. The controller 50 is programmed to receive a signal (i.e., the temperature signal T) from the temperature sensor 52, which is indicative of the temperature of the oil O in the first compartment 54.

The controller 50 is also in communication (e.g., electronic communication) with the valve 62. Accordingly, the controller 50 can command the valve 62 to move between the open and closed positions. Specifically, the controller 50 is programmed to send a signal (i.e., valve signal V) to the valve 62, thereby causing the valve 62 to move either to the open position or the closed position. For example, the controller 50 can be programmed to command the valve 62 to move from the closed position to the open position when the temperature of the oil O in the first compartment 54 is greater than a predetermined temperature (i.e., the first predetermined temperature). Further, the controller 50 can be programmed to command the fluid transfer pump 26 to adjust (e.g., increase) its pump power in order to adjust (e.g., increase) the flowrate of the heat transfer fluid F when the temperature of the oil O in the first compartment 54 is greater than another predetermined temperature (i.e., the second predetermined temperature). The second predetermined temperature may be greater than the first predetermined temperature.

Before starting the internal combustion engine 14, the oil level may be above the height of the dividing wall 53 (i.e., the second height H2). Thus, when the internal combustion engine 14 is off, the oil O can flow between the first compartment 54 and the second compartment 56 over the dividing wall 53. However, at this juncture, the valve 62 is in the closed position. Accordingly, the oil O cannot flow between the first compartment 54 and the second compartment 56 through the opening 58. After the internal combustion engine 14 is started, the oil pump 18 moves some of the oil O out of the oil pan 16 and, therefore, the oil level decreases. At this point, the oil level does not reach the height of the dividing wall 53 (i.e., the second height H2). Because at this point the valve 62 is still in the closed position, the oil O does not flow between the first compartment 54 and the second compartment 56 (either over the dividing wall 53 or through the opening 58).

As the internal combustion engine 14 keeps running, the heat transfer fluid F is heated or cooled before being introduced into the heat exchanger 32. To heat the heat transfer fluid F, heat can be transferred from the heat source 28 (e.g., exhaust manifold) to the heat transfer fluid F while the heat transfer fluid F is flowing through the input passageway 24 as discussed above. To cool the heat transfer fluid F, heat can be transferred from the heat transfer fluid F to the cooling source 30 while the heat transfer fluid F flows through the input passageway 24. The heated or cooled heat transfer fluid F is then introduced into the heat exchanger 32 while the oil O is in the first compartment 54 of the oil pan 16. At this juncture, the heat transfer fluid F flows through the heat exchanger 32 from the inlet 46 to the outlet 48. While the heat transfer fluid F flows through the heat exchanger 32, heat is transferred between the oil O disposed in the first compartment 54 of the oil pan 16 and the heat transfer fluid F flowing through the heat exchanger 32 in order to cool or warm up the oil O. Due to the heat transfer facilitated by the heat exchanger 32, the temperature of the oil O in the first compartment 54 eventually reaches its optimum temperature (i.e., the first predetermined temperature). Once the temperature sensor 52 detects that the oil O in the first compartment 14 has reached the optimum temperature (i.e., the first predetermined temperature), the controller 50 receives a signal (i.e., the temperature signal T) from the temperature sensor 52. Upon receipt of this temperature signal T, the controller 50 commands the valve 62 to move from the closed position to the open position. In response, the valve 62 moves from the closed position to the open position, thereby allowing the oil O to flow between the first compartment 54 and the second compartment 56 through the opening 58. If the temperature of the oil O exceeds an optimum temperature range, the flowrate of the heat transfer fluid F may be increased to cool the oil O in the oil pan 16. For example, if the temperature of the oil O exceeds a maximum threshold temperature (i.e., the second predetermined temperature) as measured by the temperature sensor 52, then the controller 50 can command the fluid transfer pump 26 to increase its pump power in order to increase the flowrate of the heat transfer fluid F flowing through the heat exchanger 32. The increased flowrate of the heat transfer fluid F can help cool off the oil O in the oil pan 16 until the temperature of the oil O is less than the maximum threshold temperature (i.e., the second predetermined temperature).

While the best modes for carrying out the teachings have been described in detail, those familiar with the art to which this disclosure relates will recognize various alternative designs and embodiments for practicing the teachings within the scope of the appended claims.

The invention claimed is:

1. An engine assembly, comprising:

an oil pan including an oil pan body, wherein the oil pan body includes:

an inner pan surface defining a cavity configured to collect oil;

an outer pan surface opposite the inner pan surface;

a dividing wall disposed within the cavity and coupled to the oil pan body, wherein the dividing wall divides the cavity into a first compartment and a second compartment, and the dividing wall defines an opening extending therethrough;

a valve disposed in the opening, wherein the valve has an open position and a closed position;

wherein, when the valve is in the open position, the first compartment is in fluid communication with the second compartment via the opening;

wherein, when the valve is in the closed position, the valve blocks fluid flow between the first compartment and the second compartment via the opening;

a controller in communication with the valve such that the controller commands the valve to move between the open position and the closed position;

a temperature sensor in the first compartment, wherein the temperature sensor measures a temperature of the oil in the first compartment;

wherein the controller is in communication with the temperature sensor such that the controller receives a temperature signal indicative of the temperature of the oil in the first compartment;

wherein the controller is programmed to command the valve to move from the closed position to the open position when the temperature of the oil in the first compartment is greater than a predetermined temperature;

a heat exchanger disposed within the first compartment, wherein the heat exchanger is configured to facilitate heat transfer between the oil in the first compartment and a heat transfer fluid flowing through the heat exchanger; and a fluid transfer pump in fluid communication with the heat exchanger, wherein the controller is in communication with the fluid transfer pump such that the controller commands the fluid transfer pump to adjust a pump power in order to adjust a flowrate of the heat transfer fluid.

2. The engine assembly of claim 1, wherein the first compartment has a first volume, the second compartment has a second volume, and the first volume is less than the second volume.

3. The engine assembly of claim 1, wherein the oil pan body defines a sidewall defining a perimeter of the oil pan, the sidewall has a first height, the dividing wall has a second height, and the first height is greater than the second height.

4. The engine assembly of claim 1, wherein the predetermined temperature is a first predetermined temperature, the controller is programmed to increase the pump power when the temperature of the oil in the first compartment is greater than a second predetermined temperature, and the second predetermined temperature is greater than the first predetermined temperature.

5. The engine assembly of claim 1, wherein a volume of the first compartment ranges between ¼ to ⅕ of a total volume of the cavity, and a volume of the second compartment ranges between ¾ and ⅘ of the total volume of the cavity.

6. An oil pan, comprising:

an oil pan body including:

a sidewall defining a perimeter of the oil pan body;

a bottom wall coupled to the sidewall, wherein the bottom wall and the sidewall collectively define a cavity;

a dividing wall disposed within the cavity and coupled to the oil pan body, wherein the dividing wall divides the cavity into a first compartment and a second compartment, and the dividing wall defines an opening extending therethrough;

a valve disposed in the opening, wherein the valve being has an open position and a closed position;

wherein, when the valve is in the open position, the first compartment is in fluid communication with the second compartment via the opening; and wherein, when the valve is in the closed position, the valve blocks fluid flow between the first compartment and the second compartment via the opening;

a controller in communication with the valve such that the controller commands the valve to move between the open position and the closed position;

a temperature sensor in the first compartment, wherein the temperature sensor measures a temperature of the oil in the first compartment;

wherein the controller is in communication with the temperature sensor such that the controller receives a temperature signal indicative of the temperature of the oil in the first compartment;

wherein the controller is programmed to command the valve to move from the closed position to the open position when the temperature of the oil in the first compartment is greater than a predetermined temperature;

a heat exchanger disposed within the first compartment, wherein the heat exchanger is configured to facilitate heat transfer between the oil in the first compartment and a heat transfer fluid flowing through the heat exchanger; and a fluid transfer pump in fluid communication with the heat exchanger, wherein the controller is in communication with the fluid transfer pump such that the controller commands the fluid transfer pump to adjust a pump power in order to adjust a flowrate of the heat transfer fluid.

7. The oil pan of claim 6, wherein the first compartment has a first volume, the second compartment has a second volume, and the first volume is less than the second volume.

8. The oil pan of claim 6, wherein the sidewall has a first height, the dividing wall has a second height, and the first height is greater than the second height.

9. The oil pan of claim 6, further comprising a drip pan coupled to the sidewall and disposed at least partly within the cavity, wherein the drip pan is obliquely angled relative to the sidewall.

10. The oil pan of claim 6, wherein a volume of the first compartment ranges between ¼ to ⅕ of a total volume of the cavity, and a volume of the second compartment ranges between ¾ and ⅘ of the total volume of the cavity.

11. A vehicle, comprising:

an oil pan including an oil pan body, wherein the oil pan body includes:

an inner pan surface defining a cavity configured to collect oil;

an outer pan surface opposite the inner pan surface;

a dividing wall disposed within the cavity and coupled to the oil pan body, wherein the dividing wall divides the cavity into a first compartment and a second compartment, and the dividing wall defines an opening extending therethrough;

a valve disposed in the opening, wherein the valve has an open position and a closed position;

wherein, when the valve is in the open position, the first compartment is in fluid communication with the second compartment via the opening;

wherein, when the valve is in the closed position, the valve blocks fluid flow between the first compartment and the second compartment via the opening; and a controller in communication with the valve such that the controller commands the valve to move between the open position and the closed position;

a temperature sensor in the first compartment, wherein the temperature sensor measures a temperature of the oil in the first compartment;

wherein the controller is in communication with the temperature sensor such that the controller receives a temperature signal indicative of the temperature of the oil in the first compartment;

wherein the controller is programmed to command the valve to move from the closed position to the open position when the temperature of the oil in the first compartment is greater than a predetermined temperature;

a heat exchanger disposed within the first compartment, wherein the heat exchanger is configured to facilitate heat transfer between the oil in the first compartment and a heat transfer fluid flowing through the heat exchanger; and a fluid transfer pump in fluid communication with the heat exchanger, wherein the controller is in communication with the fluid transfer pump such that the controller commands the fluid transfer pump to adjust a pump power in order to adjust a flowrate of the heat transfer fluid.

12. The vehicle of claim 11, wherein a volume of the first compartment ranges between ¼ to ⅕ of a total volume of the cavity, and a volume of the second compartment ranges between ¾ and ⅘ of the total volume of the cavity.

* * * * *